United States Patent [19]

Stelling

[11] 4,436,356

[45] Mar. 13, 1984

[54] OVEN SUPPORTING APPARATUS INCORPORATING SLIDABLE COOKWARE SUPPORT

[76] Inventor: Desi D. Stelling, 19218 N. 17th Ave., Phoenix, Ariz. 85027

[21] Appl. No.: 185,190

[22] Filed: Sep. 8, 1980

[51] Int. Cl.[3] ..... F24C 15/16

[52] U.S. Cl. ..... 312/281; 312/15; 312/279; 312/282; 126/278; 126/332; 108/93; 269/289 R

[58] Field of Search ..... 312/281, 282, 209, 279, 312/15; 248/DIG. 12, 673, 346; 269/302.1, 289 R; 108/93, 28; 126/278, 214, 216, 221, 332

[56] References Cited

U.S. PATENT DOCUMENTS

| | | | |
|---|---|---|---|
| 132,165 | 10/1872 | Maples . | |
| 137,996 | 4/1873 | Barstow | 126/332 |
| 531,632 | 1/1895 | Hamilton | 126/221 |
| 571,349 | 11/1896 | Farquhar | 269/302.1 |
| 608,533 | 8/1898 | Turbeville | 126/332 |
| 797,644 | 8/1905 | Trahern | 269/302.1 |
| 1,032,575 | 7/1912 | Willson | 126/214 R |
| 1,387,402 | 8/1921 | Hutch | 126/278 |
| 1,393,065 | 10/1921 | Young | 312/15 |
| 1,431,953 | 10/1922 | Henoch | 126/332 |
| 1,513,938 | 11/1924 | Shea | 269/289 |
| 1,569,207 | 1/1926 | Sears | 312/15 |
| 2,566,954 | 9/1951 | Murray | 108/93 |
| 2,672,384 | 3/1954 | Richards | 312/317 R |
| 2,844,342 | 7/1958 | Anderson | 248/673 |
| 3,185,114 | 5/1965 | Consin . | |
| 3,224,595 | 12/1965 | Sherley | 248/DIG. 12 |
| 3,545,249 | 12/1970 | Brown | 248/346 |
| 3,808,084 | 4/1974 | Doty | 248/346.1 |
| 3,834,778 | 9/1974 | Morrison et al. | 312/209 |
| 3,877,668 | 4/1975 | Von Sande . | |
| 3,899,982 | 8/1975 | Fetzek . | |
| 4,103,857 | 8/1978 | Levenhagen | 248/346 |
| 4,120,549 | 10/1978 | Bureau | 312/281 |

OTHER PUBLICATIONS

Sunset Magazine, published by Lane Publishing Co., Menlo Park, Calif., Sep. 1980, see p. 120.

*Primary Examiner*—Victor N. Sakran
*Attorney, Agent, or Firm*—Cahill, Sutton & Thomas

[57] ABSTRACT

A compact base unit for use in conjunction with a microwave oven or the like includes a lower surface for resting upon a counter top, an upper surface for supporting the oven, and a storage area disposed between the upper and lower surfaces. A work surface is slidingly secured to the base unit by a roller track assembly for allowing the work surface to be either retracted within the storage area of the base unit or slidingly extended in front of the base unit. The base unit includes a camming member connected to a push rod for partially advancing the work surface from the storage area when the push rod is actuated. The work surface includes a cookware support molded of silicone rubber to form a series of concentric, stepped depressions for securely supporting various sized cookware utilized in conjunction with the oven.

7 Claims, 8 Drawing Figures

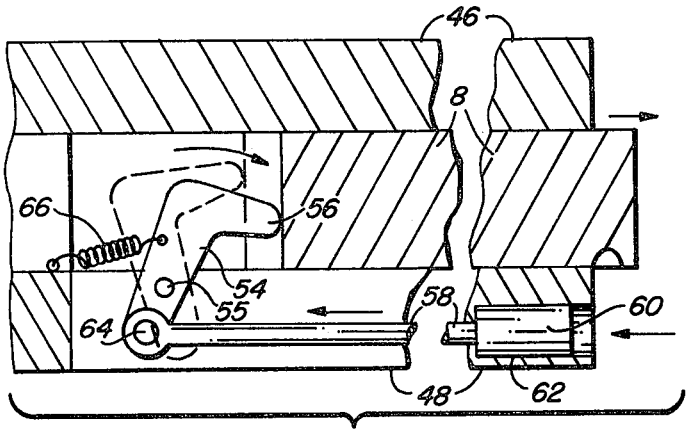
FIG-5
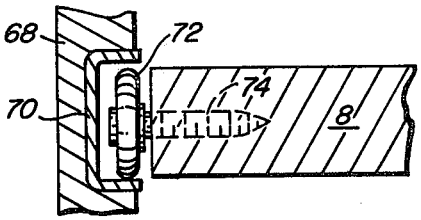
FIG-6
FIG-7
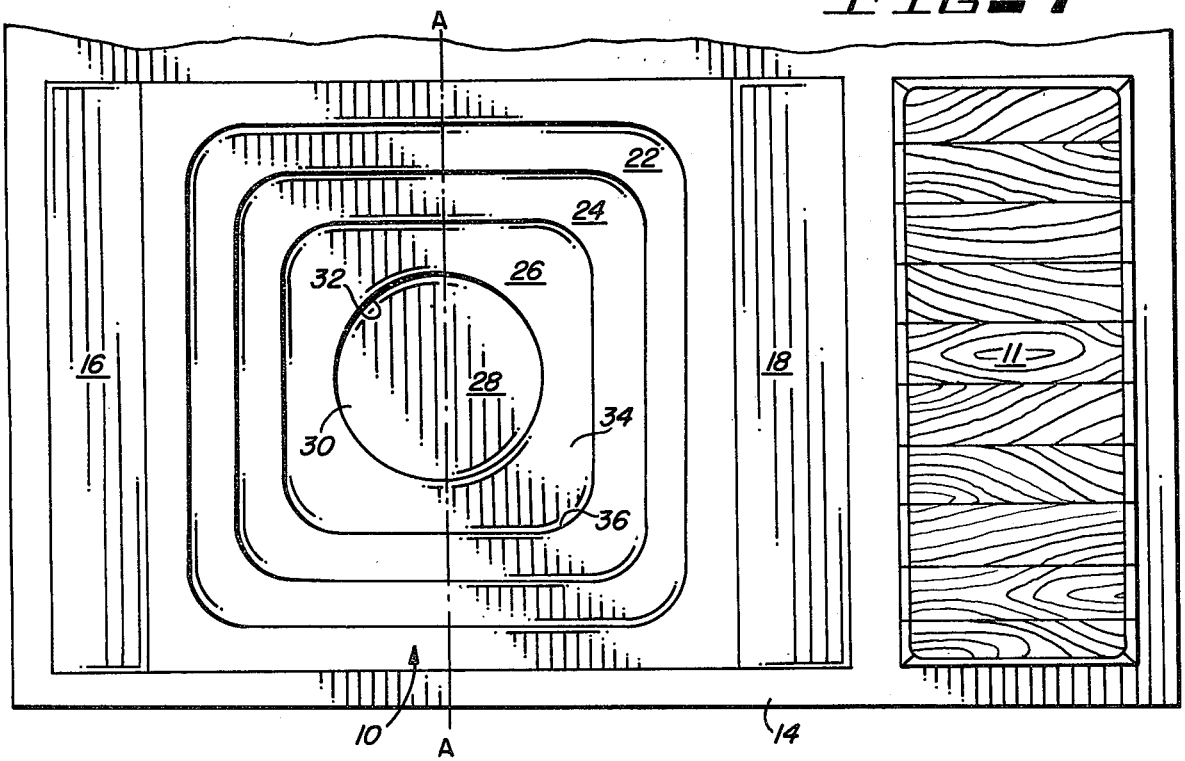
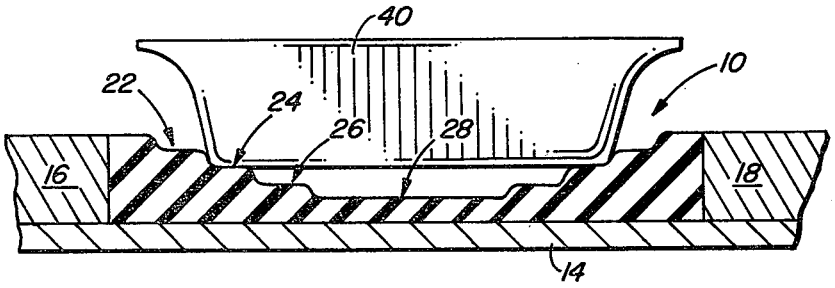
FIG-8

OVEN SUPPORTING APPARATUS INCORPORATING SLIDABLE COOKWARE SUPPORT

BACKGROUND OF THE INVENTION

1. Field of the Invention:

The present invention relates generally to apparatus for supporting ovens, and more particularly, to an apparatus for supporting an oven and providing added work space for securely supporting cookware used in conjunction with the oven.

2. Description of the Prior Art:

Microwave ovens have become increasingly popular primarily as a result of their convenience and efficient useage of energy. When used in the home, the microwave oven is typically placed upon a counter top within the kitchen adjacent the food preparation area. An area of approximately five square feet of counter space is required to support a conventional microwave oven. In many kitchens, counter space is already in short supply; the loss of the counter space needed to support the microwave oven only worsens the shortage of counter space.

When utilizing a microwave oven, it is often necessary to remove the food container from the oven before cooking is completed to allow stirring, mixing, or basting of the food being cooked. Typically, the food container is placed on a counter top or another smooth surface which does not provide reasonable stability of the food container when the food is mixed or stirred. For this reason, it is not uncommon for cookware used in conjunction with microwave ovens to slip and break during mixing and stirring operations.

U.S. Pat. No. 2,672,384 discloses a fold-away table structure slidably carried by a floor-mounted cabinet. However, such a fold-away table has several disadvantages in relation to compensating for counter space occupied by a microwave oven. For example, the fold-away table includes support legs which must be installed and subsequently stowed away each time the table is used. In addition, the fold-away table requires that extensive modifications be made to an existing cabinet in order to incorporate such a table. Should it be desirable to relocate the microwave oven to a different area of the kitchen or to a different home, the fold-away table is not easily removable from its prior location. Furthermore, the fold-away table provides a smooth surface on which cookware may slide when the food contained therein is stirred or mixed.

Accordingly, it is an object of the present invention to provide an apparatus for use in conjunction with an oven, the apparatus providing a work surface to compensate for counter space used to support the oven.

It is another object of the present invention to provide an apparatus for use in conjunction with an oven and providing a retractable work surface immediately in front of the oven.

It is yet another object of the present invention to provide an apparatus for use in conjunction with an oven, the apparatus including a non-slip cookware support for supporting various sized cookware used in conjunction with the oven.

It is a further object of the present invention to provide a retractable work surface for use in conjunction with an oven wherein no modifications need be made to cabinetry or counter tops already existing within a kitchen.

It is a still further object of the present invention to provide a retractable work surface for use in conjunction with an oven wherein the retractable work surface may be easily relocated whenever the oven is relocated.

These and other objects of the present invention will become apparent to those skilled in the art as the description thereof proceeds.

SUMMARY OF THE INVENTION

Briefly described, and in accordance with one embodiment thereof, the present invention relates to an apparatus for use in conjunction with an oven, the apparatus including a base, a work surface, and a mechanism for slidingly securing the work surface to the base. The base includes a lower surface for resting upon a counter, an upper surface for supporting the oven, and a storage area disposed between the upper and lower surfaces. The work surface is retracted within the storage area of the base when not in use. When the work surface is to be used, the slide mechanism allows the work surface to be slidingly extended in front of the base.

Preferably, the work surface incorporates a cookware support having a plurality of concentric, stepped depressions for securely supporting a corresponding plurality of different sized cookware used in conjunction with the oven. The cookware support is made of an elastic; heat resistant material, such as silicone rubber.

The front edge of the work surface is flush with the front portion of the base when the work surface is in its retracted position. A camming member pivotally connected to the base is operated by a slidable push rod for partially advancing the work surface out of the storage area within the base.

In another form of the present invention, the retractable cookware support may be slidingly secured within a built-in kitchen cabinet supporting an oven wherein the cookware support can be extended in front of the cabinet immediately below the oven supported thereby.

BRIEF DESCRIPTION OF THE DRAWINGS

FIG. 5 is an enlarged partial view of the camming member and push rod.

FIG. 6 is a partial cross-sectional front view of a guide track and roller assembly used to slidingly secure the work surface to the base unit.

FIG. 7 is a top view of the work surface showing the cookware support and a removable cutting board.

FIG. 8 is a cross-sectional view of the cookware support and a food container supported thereby.

DETAILED DESCRIPTION OF THE PREFERRED EMBODIMENT

Figure 1:
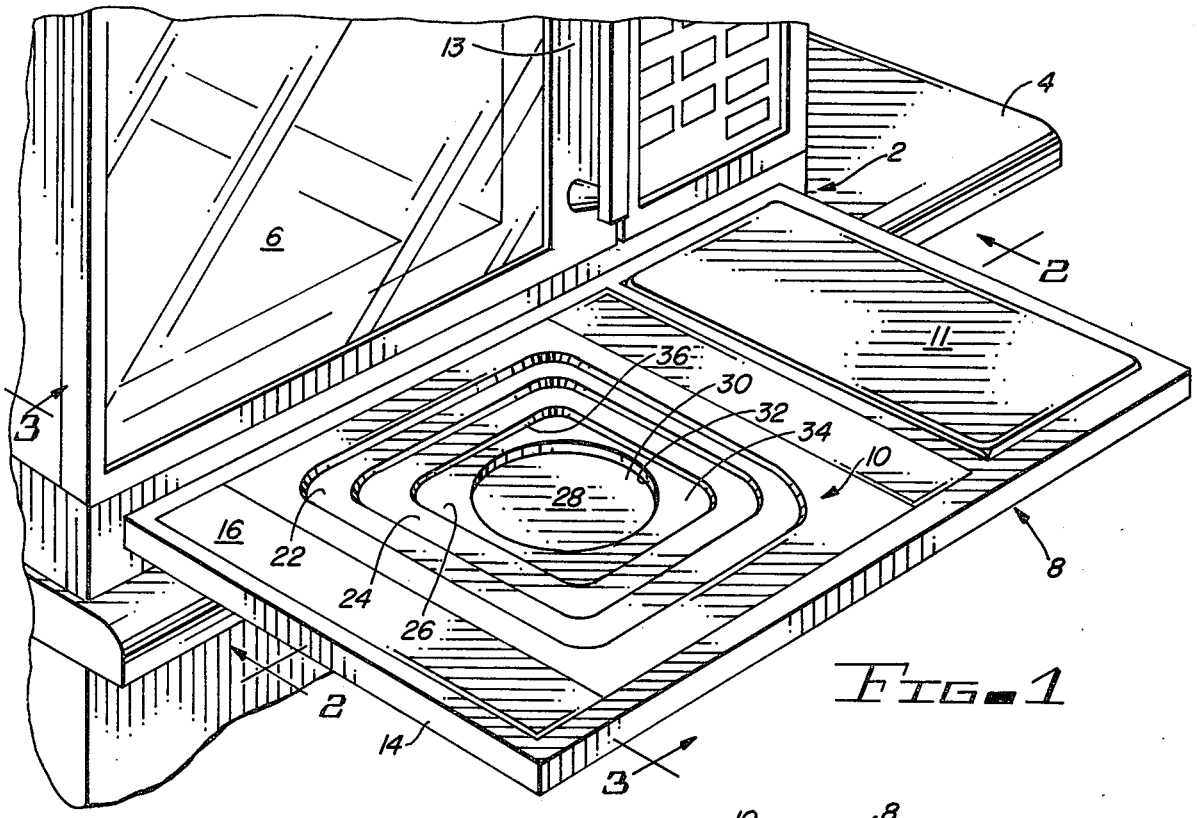
FIG. 1 is a perspective view of a base unit used to support a microwave oven and including a slidable work surface incorporating a cookware support.
Figure 3:
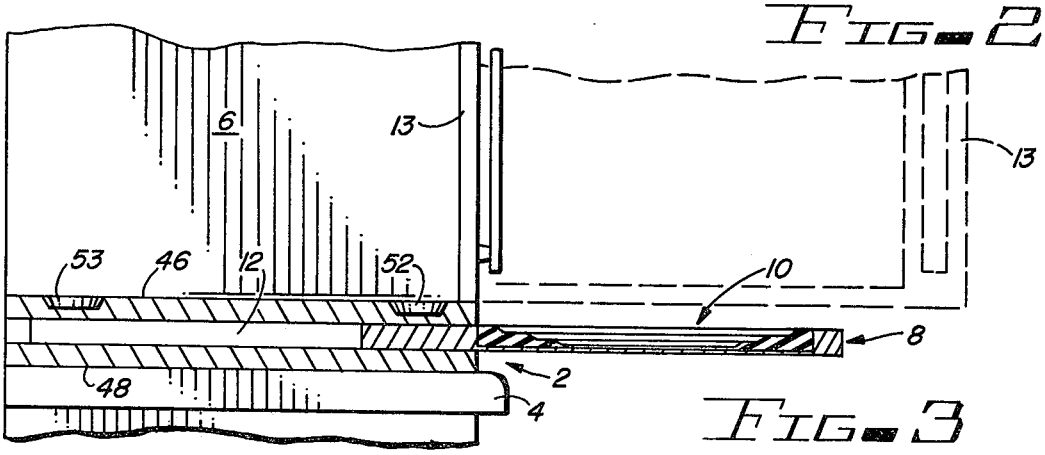
FIG. 3 is a cross-sectional side view of the base unit and work surface shown in FIG. 1 taken through lines 3—3.

In FIG. 1, a base unit, designated generally by reference numeral 2, is shown resting upon a counter top 4 and supporting a conventional microwave oven 6. Extending from the front portion of base unit 2 is a retractable work surface 8 which, in the preferred embodiment of the present invention, includes a cookware support 10. Work surface 8 may also include a cutting board 11 which provides additional work space; cutting board 11 is removable from work surface 8 for cleaning. Referring briefly to FIG. 3, it will be seen that base unit 2 includes a storage area 12 into which work surface 8 may be retracted when not in use. When in its extended position in front of base unit 2, work surface 8 is disposed sufficiently below microwave oven 6 to allow microwave oven door 13 to be freely moved between its closed position and its opened position (indicated by dashed lines 13 in FIG. 3).

Figure 2:
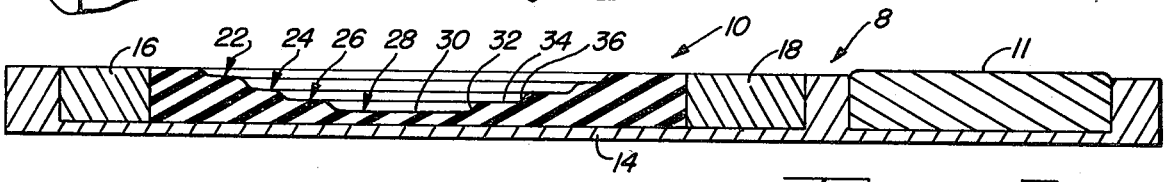
FIG. 2 is a cross-sectional view of the work surface shown in FIG. 1 taken through lines 2—2.

Referring now to FIGS. 1, 2 and 7, work surface 10 includes a base section 14 made of a decorative wood for supporting cookware support 10 and cutting board 11. Disposed on opposite sides of cookware support 10 are wooden trim members 16 and 18 for supporting utensils used to mix or stir food being cooked within oven 6. Cookware support 10 is molded from an elastic, heat-resistant material to form a plurality of concentric, stepped depressions for securely supporting various sized cookware. Preferably, cookware support 10 is molded of silicone white rubber, such as the type commercially available from General Electric Corporation under the designation "Silicone Rubber Compound-Part No. 2567112". The above mentioned silicone rubber compound can withstand temperatures as high as 660° Fahrenheit without deterioration.

The concentric, stepped depressions molded within cookware support 10 form a plurality of cookware supporting surfaces 22, 24, 26 and 28. The areas of each of these supporting surfaces is selected to be commensurate with the dimensions of the bottom portions of cookware typically utilized with oven 6. As shown in FIG. 7, supporting surfaces 22, 24 and 26 are generally square in shape and include rounded corner areas while supporting surface 28 is circular. When measured across reference line A—A shown in FIG. 7, supporting surface 22 measures approximately nine and three-quarter inches across, supporting surface 24 measures approximately seven and one-half inches across, supporting surface 26 measures approximately six inches across, and supporting surface 28 measures approximately four and three-quarter inches across.

Still referring to FIGS. 1, 2 and 7, each supporting surface within cookware support 10 includes a horizontally disposed region for supporting the bottom portion of a food container and a side wall extending upwardly from the outer periphery of the horizontally disposed region for maintaining the food container upon the horizontally disposed region. Supporting surface 28 includes a horizontally disposed region 30 and a side wall 32 extending upwardly from the outer periphery of horizontally disposed region 30 to supporting surface 26. Similarly, supporting surface 26 includes a horizontally disposed region 34 and a side wall 36 extending upwardly from the outer periphery of horizontally disposed region 34 to supporting surface 24. Each side wall is approximately one-quarter inch in height.

In FIG. 8, food container 40 is shown supported by supporting surface 24 of cookware support 10. The bottom portion of food container 40 is supported by the horizontally disposed region of supporting surface 24. The side walls of supporting surface 24 extend around the grippingly engage the bottom portion of food container 40. Therefore, the contents of food container 40 may be stirred or mixed without dislodging food container 40 from supporting surface 24.

Figure 4:
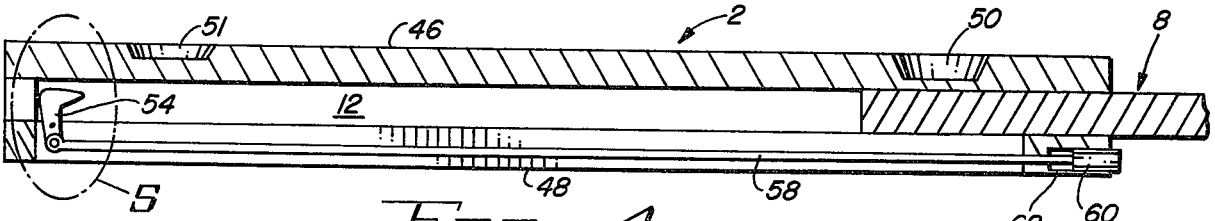
FIG. 4 is a cross-sectional view of the base unit illustrating a camming member and a push rod for advancing the work surface out of the base unit.

Referring now to FIGS. 3 and 4, it may be seen that base unit 2 includes an upper surface 46 for supporting microwave oven 6 and a lower surface 48 for resting upon counter 4. In addition, upper surface 46 of base unit 2 may have depressions such as 50 and 51 formed therein for receiving rubber feet 52 and 53 (see FIG. 3), respectively, typically provided with most microwave ovens. Depressions 50 and 51 maintain microwave oven 6 properly aligned with base unit 2.

Base unit 2 is preferably twenty-four inches long and seventeen inches wide in accordance with the base dimensions of most microwave ovens presently available. Thus, base unit 2 occupies no more counter space than would microwave oven 6. Furthermore, the distance between upper surface 46 and lower surface 48 is three-five inches in the preferred embodiment of the invention, allowing base unit 2 to be highly compact. Base unit 2 may be constructed of a decorative wood to enhance its appearance.

When work surface 8 is retracted within storage area 12 of base unit 2, the front edge of work surface 8 lies generally flush with the front portion of base unit 2. FIGS. 4 and 5 illustrate a camming mechanism for partially advancing work surface 8 from storage area 12 to allow the user to grasp the front edge of work surface 8. Camming member 54 is pivotally connected by a pin 55 to base unit 2 proximate the rear portion of storage area 12. Camming member 54 has a first end 56 for engaging the rear portion of work surface 8 and advancing it forward. A push rod 58 is provided for controlling camming member 54. Push rod 58 has a first end coupled to a slidable actuator 60 disposed within a guide channel 62 formed in the front portion of base unit 2. The end of push rod 58 opposite actuator 60 and the end of camming member 54 opposite end 56 are pivotally connected to each other by a pin 64. Coupled between base unit 2 and camming member 54 is a spring 66 for biasing first end 56 rearward and away from work surface 8. When the operator pushes inwardly on actuator 60, push rod 58 pivots camming member 54 in a clockwise direction (see FIG. 5) for pushing end 56 against the rear edge of work surface 8, thereby partially extending work surface 8 out of base unit 2. The user then grasps the protruding front edge of work surface and pulls it outwardly to its full extension.

In order that work surface 8 may slide more easily into and out of base unit 2, a roller track assembly may be utilized as shown in FIG. 6. Side wall 68 of base unit 2 may include a channel in which a metal track or guide rail 70 is inset. One or more roller wheels 72 may be attached to each of the side edges of work surface 8 near the rear portion thereof by an axle 74 which threadedly engages work surface 8. A stop (not shown) may be provided along track 70 to limit the forward travel of work surface 8. For ease of illustration, the roller track assembly shown in FIG. 6 is of the type having a single track attached to each side of base unit 2. However, those skilled in the art will appreciate that a roller track assembly having dual tracks may also be used to slidingly secure work surface 8 to base unit 2. In this instance, a second pair of tracks is attached to work surface 8 proximate the side edges thereof for movement therewith, and a pair of rollers are secured to base unit 2 proximate the front portion thereof for riding within the second pair of tracks. It will also be appreciated that the roller track assembly used to slidingly secure work surface 8 to base unit 2 may be disposed below work surface 8 rather than along the edges thereof.

Those skilled in the art will now appreciate that a base unit for use in conjunction with an oven has been described which provides a retractable work surface that partially compensates for the counter space lost in order to support the oven. The work surface is conveniently provided directly in front of and below the oven and incorporates a non-slip cookware support adapted to be utilized in conjunction with a variety of different sized cookware. The described base unit may be utilized with virtually any kitchen counter top without requiring any modifications to existing cabinetry and may be easily relocated whenever desired.

While the invention has been described with reference to a preferred embodiment thereof, the description is for illustrative purposes only and is not to be construed as limiting the scope of the invention. Although the present invention is particularly well adapted for use in conjunction with microwave ovens, those skilled in the art will realize that the present invention may also be utilized in conjunction with convection ovens. Although the preferred embodiment of the present invention is in the form of a base unit which can be rested upon a counter top, those skilled in the art will also appreciate that a work surface incorporating the novel cookware support may, if desired, be slidingly secured directly to built-in cabinetry within the kitchen. Such a built-in slidable cookware support may advantageously be disposed immediately below a counter top or immediately below a built-in oven. Various other modifications and changes may be made by those skilled in the art without departing from the true spirit and scope of the invention, as defined by the appended claims.

I claim:

1. A cookware support for use in conjunction with an oven and for supporting at least first and second food containers each having a bottom portion, the bottom portion of the first food container being larger than the bottom portion of the second food container, said cookware support comprising in combination:

a. a base;

b. a first supporting surface supported by said base, said first supporting surface having an area commensurate with the bottom portion of the first food container for supporting the first food container, said first supporting surface including a first horizontally disposed region having an outer periphery commensurate with the bottom portion of the first food container, said first supporting surface also including a first side wall extending upwardly from the outer periphery of said first horizontally disposed region for maintaining the first food container upon said first horizontally disposed region; and c. a second supporting surface supported by said base concentric with and depressed within and below said first supporting surface, said second supporting surface having an area commensurate with the bottom portion of the second food container for supporting the second food container, said second supporting surface including a second horizontally disposed region having an outer periphery commensurate with the bottom portion of the second food container, said second supporting surface also including a second side wall extending upwardly from the outer periphery of said second horizontally disposed region to said first horizontally disposed region for maintaining the second food container upon said second horizontally disposed region;

d. said first and second supporting surfaces being made of an elastic material for enabling said first and second side walls to grippingly engage the bottom portions of the first and second food containers, respectively.

2. A cookware support as recited in claim 1 wherein said elastic material is silicone rubber.

3. An apparatus for use in conjunction with an oven, said apparatus comprising in combination:

a. a base having a lower surface for resting upon a counter and an upper surface for supporting the oven, said base further including a storage area disposed between said upper surface and said lower surface;

b. a work surface including a cookware support for supporting cookware used in conjunction with the oven;

c. slide means for slidingly securing said work surface to said base, said slide means allowing said work surface to be retracted within said storage area of said base when said work surface is not in use and allowing said work surface to be slidingly extended in front of said base when said work surface is to be used; and d. wherein said cookware support includes a plurality of concentric, stepped depressions for supporting a corresponding plurality of different sized cookware, said cookware support being made of an elastic, heat resistant material for enabling said plurality of concentric, stepped depressions to grippingly engage bottom portions of said different sized cookware.

4. An apparatus as recited in claim 3 wherein said cookware support is molded of silicone rubber.

5. An apparatus as recited in claim 3 wherein said work surface includes a cutting board.

6. An apparatus as recited in claim 3 further including camming means attached to said base, said camming means including an actuator for partially extending said work surface from said storage area when said actuator is operated by a user.

7. An apparatus as recited in claim 6 wherein said camming means comprises:

a. a camming member pivotally connected to said base proximate the rear portion of said storage area, said camming member having a first end for engaging the rear portion of said work surface and having a second end opposite the first end; and b. a push rod slidingly mounted to said base, said push rod having a first end proximate the front portion of said base and coupled to said actuator, said push rod also having a second end opposite the first end of said push rod, the second end of said push rod engaging the second end of said camming member for pivoting the first end of said camming member toward the front portion of said base when the user operates the actuator to slide said push rod toward the rear portion of said base.

* * * * *